United States Patent [19]

Ubukata et al.

[11] Patent Number: 5,015,985

[45] Date of Patent: May 14, 1991

[54] THERMALLY RESPONSIVE SWITCH

[75] Inventors: Susumu Ubukata; Yasukazu Mizutani, both of Nagoya, Japan

[73] Assignee: Susumu Ubukata, Nagoya, Japan

[21] Appl. No.: 486,204

[22] Filed: Feb. 28, 1990

[30] Foreign Application Priority Data

Mar. 1, 1989 [JP] Japan ..... 1-49625

[51] Int. Cl.[5] ..... H01H 37/12; H01H 37/54

[52] U.S. Cl. ..... 337/368; 337/372; 337/107

[58] Field of Search ..... 337/368, 380, 372, 360, 337/347, 107, 94, 82, 57

[56] References Cited

U.S. PATENT DOCUMENTS 4,167,721 9/1979 Senor et al. ..... 337/372

4,521,760 6/1985 Carbone et al. ..... 337/368

*Primary Examiner*—Harold Broome

*Attorney, Agent, or Firm*—Foley & Lardner

[57] ABSTRACT

A thermally responsive switch includes an elliptic dome-shaped receptacle, a support conductively secured at one of two ends to an inner surface of one of two ends of the receptacle in the direction of its length, a bimetallic thermally responsive element secured at one end to the other end of the support with the other end opposite to an inner surface of the other end of the receptacle in the direction of its length with a predetermined space interposed therebetween, the thermally responsive element carrying a movable contact on the other end, and a metallic lid secured to the open end of the receptacle so as to hermetically close the open end of the receptacle. The lid has a through-hole through which a terminal pin is disposed with an electrically insulative material charged in the through-hole. Alternatively, two terminal pins may be disposed through two through-holes respectively. A fixed contact is secured to a portion of the terminal pin positioned in the receptacle so that the movable contact is engaged with and disengaged from the fixed contact. The receptacle includes a deformable contact pressure adjusting portion provided in the vicinity of the portion of the receptacle to which the support is secured.

2 Claims, 2 Drawing Sheets

THERMALLY RESPONSIVE SWITCH

BACKGROUND OF THE INVENTION

This invention relates to a thermally responsive switch making and breaking an electrical circuit by engaging and disengaging a movable contact with and from a fixed contact by means of a bimetallic or trimetallic thermally responsive element which deforms when subjected to heat, and more particularly to such a thermally responsive switch disposed in an enclosed housing together with an electric motor driving a compressor of a refrigerator or air conditioning system, a refrigerant, lubricating oil and the like for protecting the motor against overheating and overcurrent in response to the temperature of the motor, refrigerant gas or the like.

Various thermally responsive switches of the type described above have been proposed. For example, Japanese Laid-open Patent Application (Kokai) No. 61-24118 discloses a thermostat comprising a fixed contact provided in the vicinity of a closed end of a cylindrical housing, a header plate welded to an open end side of the housing, a pair of terminal pins secured to the header plate for electrically insulative relation thereto, and a bimetallic thermally responsive element secured to one of the terminal pins and carrying a movable contact.

In the above-described thermostat, the fixed contact needs to be welded in the vicinity of the closed end of the deep drawn housing and accordingly, the assembling efficiency is considerably low. Moreover, it is difficult to check the positions of the contacts and assembled products for product assurance. Additionally, it is difficult to position the movable contact secured to one end of the bimetallic thermally responsive element with respect to the fixed contact disposed in the vicinity of the closed end of the header plate so that the movable contact engages and disengages from the fixed contact. Further, in the case where a resistive heating element having a resistive value larger than that of the bimetallic element is enclosed in the housing, a plurality of terminal pins need to be secured to the header plate in insulative relation thereto, which renders the thermostat large-sized.

The inventors of the present application formerly applied to the Japanese Patent Office for a utility model and the application has been assigned Published Utility Model Application (Kokoku) No. 58-40505, which discloses an enclosed thermal relay comprising first and second outer cover members composing an enclosed housing. The second housing member serves only as a lid and a fixed contact and a thermally responsive element carrying a movable contact are provided in the second housing member. Accordingly, the first housing member is rendered large-sized as compared with the thermally responsive element, which is disadvantageous from a point of view of provision of a small-sized thermally responsive switch. Further, an operative temperature of the thermally responsive element needs to be calibrated before the housing is hermetically sealed. Additionally, the housing has a configuration disadvantageous against an external force. Accordingly, the calibrated operative temperature of the thermally responsive element is likely to be changed under the influence of a shock, which entails a disadvantage in reliability of the calibrated operative temperature of the thermally responsive element. Although changes in the design of the thermally responsive switch such as increase in the thickness of the parts may be made for solution of those disadvantages, such design changes incur economical losses and the lowering of the thermal responsibility of the switch. Moreover, it is difficult to adapt the thermally responsive switch to various electric motors having different horsepowers or rated outputs.

SUMMARY OF THE INVENTION

Therefore, an object of the present invention is to provide a thermally responsive switch wherein a desirable accuracy in the relative positional relationship between movable and fixed contacts and dimensional relationships among parts can be ensured with ease and, yet, the assembling work and calibration of the operative temperature may be performed with ease.

Another object of the invention is to provide a thermally responsive switch which can retain desirable operative characteristics thereof, initially determined, for a sufficient long period.

Further, another object of the invention is to provide a thermally responsive switch which is compact in size and durable.

The present invention provides a thermally responsive switch comprising a generally elliptic dome-shaped receptacle formed of a metallic material and having an open end, a support formed of an electrically conductive material and having two ends, the support being conductively secured at one end to an inner surface of one of two ends of the receptacle in the direction of the length thereof, and a thermally responsive element disposed in the receptacle and having two ends. The thermally responsive element is secured at one end to the other end of the support and the other end of the thermally responsive element is opposite to an inner surface of the other end of the receptacle in the direction of the length thereof with a predetermined space interposed therebetween so that a movement range of the other end of the thermally responsive element is limited. The thermally responsive element has a shallow dish-shaped portion formed approximately in the center thereof for a snap action and a movable contact carried on said other end thereof.

The thermally responsive switch further comprises a metallic lid member secured to the open end of the receptacle so as to hermetically close the open end of the receptacle, the lid member having a wall thickness larger than that of the receptacle and a through-hole, a terminal pin formed of a conductive material and inserted through the through-hole of the lid member to thereby be hermetically held in position with an electrically insulative material charged in the through-hole, the terminal pin having a fixed contact secured to a portion thereof positioned in the receptacle so that the movable contact is engaged with and disengaged from the fixed contact, and a contact pressure adjusting portion provided in the vicinity of the portion of the receptacle to which the support is secured, the contact pressure adjusting portion being deformed when subjected to an external force so that the contact pressure between the movable and fixed contacts is adjusted.

Preferably, the thermally responsive switch of the invention may include a first terminal pin to which the fixed contact is secured, a second terminal pin electrically insulated from the first terminal pin, and a resistive heating element disposed at the lid member side and having two ends connected to the second terminal pin and the lid member, respectively.

In accordance with the above-described thermally responsive switch, the positional matching of the movable and fixed contacts may be performed with ease since the receptacle is formed into a shallow elliptic configuration. The movement range of the thermally responsive element is determined by the space between the fixed contact and the inner surface of the elliptic dome-shaped receptacle. This space may be accurately determined when an amount of melted portion is previously determined in the case where the receptacle and lid member are hermetically welded together. In this case, since a superfluous space is not provided and the movement range of the movable contact is narrowed when an external force acts on the switch, occurrence of deviation in the operative temperature of the thermally responsive element is reduced.

Since the thermally responsive switch of the invention may be applied to both cases where a single terminal pin is employed and where two terminal pins are employed, the thermally responsive switch may be applied to various electric motors of different rated outputs. Moreover, since a single or two terminal pins are disposed at the lid member side, the switch is rendered compact. Nevertheless, a space may be assured for installing the resistive heating element series connected to the thermally responsive element and having a desirable resistance value so that the thermally responsive switch is applied to various electric motors the rated outputs of which differ over a wide range.

Furthermore, a slight amount of deformation is applied to the receptacle so that the operative temperature of the thermally responsive element is set in the wide range and consequently, the hermetic sealing is prevented from being damaged when the operative temperature of the thermally responsive element is set.

The above-described advantages make it possible to apply the thermally responsive switch of the invention to various electric motors having different rated outputs in a wide range.

Other objects of the present invention will become obvious upon an understanding of the illustrative embodiment taken in conjunction with the accompanying drawings and various advantages not referred to herein will occur to one skilled in the art upon employment of the invention in practice.

DESCRIPTION OF THE PREFERRED EMBODIMENT

Figure 1:
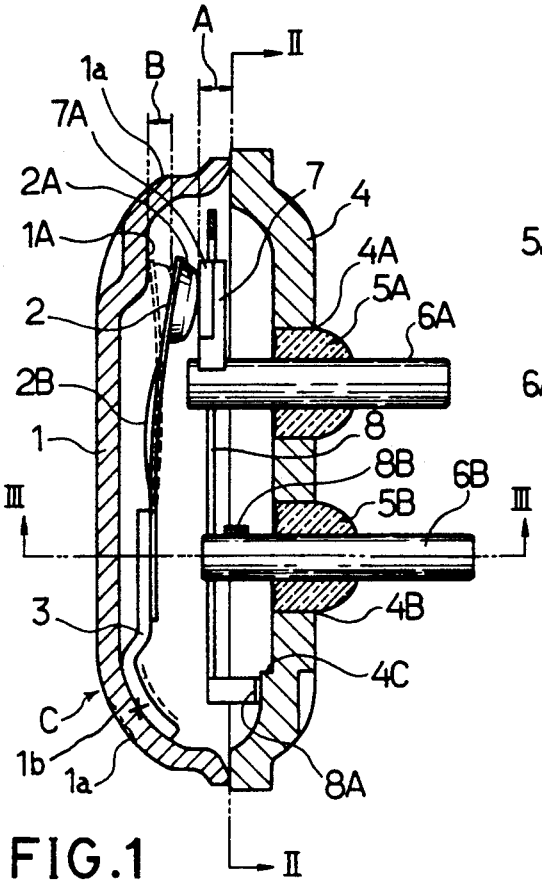
FIG. 1 is a longitudinal sectional view of a thermally responsive switch of an embodiment of the present invention.
Figure 2:
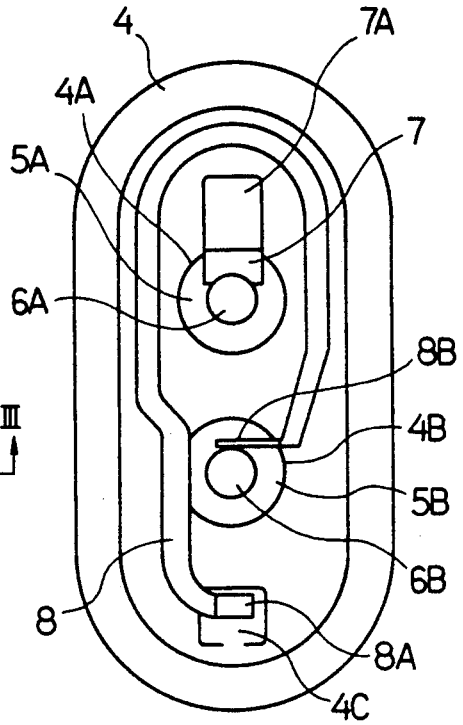
FIG. 2 is a plan view of a lid member of the switch with parts installed therein in the state before the securing of the lid member to a receptacle, as viewed in the direction of arrows in FIG. 1.
Figure 3:
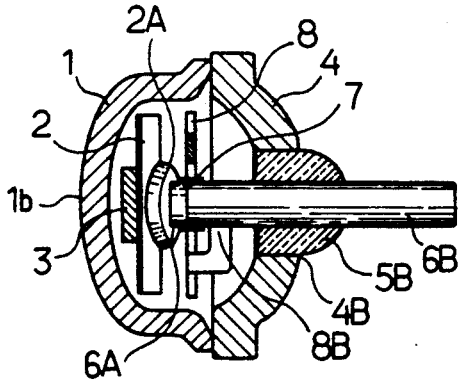
FIG. 3 is a transverse sectional view of the switch as viewed in the direction of arrows along line III—III.

Referring first to FIGS. 1 to 3, a generally elliptic dome-shaped receptacle 1 of the thermally responsive switch is formed from a steel plate with a press by way of drawing and has two nearly spherical portions 1*a* at opposite ends in the direction of its length respectively and a middle semicircular portion 1*b*. Receptacle 1 has an open end in the right-hand side, as viewed in FIG. 1. A conventional thermally responsive element 2 is provided in receptacle 1. Thermally responsive element 2 is formed of a bimetal or the like and has a generally rectangular or oval configuration in plane. A shallow dish-shaped portion 2B is formed in approximately the center of thermally responsive element 2 for the snap action inducing purpose. A movable contact 2A formed from a silver alloy is secured to the moving end side of thermally responsive element 2 by way of the spot welding. The other end of thermally responsive element 2 is secured by way of the spot welding to a support 3 formed of a suitable metallic plate. The lower end of support 3 is electrically conductively secured at the portion marked with x to the inner surface of lower spherical portion 1*a* of receptacle 1 by the spot welding, as viewed in FIG. 1. A lid member 4 is formed from a steel plate having a larger thickness than receptacle 2 by pressing. Lid member 4 is secured to the open end side of receptacle 2 by way of the ring projection welding, thereby hermetically sealing receptacle 1. Prior to the securing of lid member 4 to receptacle 1, through-holes 4A and 4B are formed approximately in the central portion of lid member 4. Then, conductive terminal pins 6A and 6B are inserted through holes 4A and 4B respectively and secured in position by sealing materials 5A and 5B each having a suitable thermal expansion coefficient such as glass, by a well-known compression hermetic sealing. A fixed contact 7, formed by affixing contact-making silver-alloy strip 7A, is welded to the end of terminal pin 6A positioned in receptacle 2 so as to intersect nearly perpendicularly thereto. The distance A between the surface of contact strip 7A and the peripheral edge plane of lid member 4 shown by line II—II in FIG. 1 may be controlled with ease as follows. A stepped portion 4C is formed on the lower inside of lid member 4 as viewed in FIG. 1. An end 8A of a resistive heating element 8 is secured to stepped portion 4C and the other end 8B thereof is welded to terminal pin 6B. When receptacle 1 and lid member 4 are hermetically welded together, the melting of the parts due to the welding causes a dimensional reduction between receptacle 1 and lid member 4 and reduction of dimension A. Previously taking it into account that the dimensional reduction amounts to, for example, 0.2 millimeters, a small projection 1A, formed by deformation by the application of pressure, is provided on the inner surface of upper spherical portion 1*a* so that the movement range of thermally responsive element 2 is limited when the element takes the position shown by dotted line in FIG. 1 with the change of the curvature of dish-shaped portion 2B owing to increase of the ambient temperature to a predetermined operating value. For calibrating the operative temperature of thermally responsive element 2 so that the element snaps at a predetermined ambient temperature, for example, 150° C., the lower portion of receptacle 1 shown by arrow C in FIG. 1 or the portion substantially supporting thermally responsive element 2 is externally deformed slightly, so that an inwardly deformed portion 1B is formed as exaggeratedly shown by alternate long and two short dashes in FIG. 1. Since support 3 is secured to the inside of the portion shown by arrow C and thermally responsive element 2 secured to support 3 carries movable contact 2A at the distal end, a slight displacement of the portion shown by arrow C is amplified as the displacement of movable contact 2A. Thus, the contact pressure may be set over a wide range by means of such a slight deformation of the receptacle wall that the pressure proof characteristics is not affected by the deformation.

When the above-described thermally responsive switch is connected to a motor circuit so that all the motor current flows through terminal pins 6A and 6B of the thermally responsive switch, the motor current flows through an electrical path formed by terminal pin 6A, fixed contact 7, movable contact 2A, thermally responsive element 2, support 3, receptacle 1, stepped portion 4C of lid member 4, resistive heating element 8 and terminal pin 6B in sequence. When a large short-term starting current and a normal operating current flow into the motor, thermally responsive element 2 is subjected to heat generated at the above-mentioned electrical path but the temperature of thermally responsive element 2 is not increased to the predetermined operative temperature, 150° C. Accordingly, the motor continues driving. On the other hand, some abnormal condition increases a motor load and therefore, an amount of current flowing into the motor is increased. When this condition continues or when the temperature of the refrigerant gas of the air conditioner or the like is abnormally increased, the thermally responsive switch is operated in response to the atmospheric temperature of the enclosed housing in which the thermally responsive switch is provided or the ambient temperature of the thermally responsive switch even if the operating current is normal, thereby cutting off the current flowing into the motor.

Furthermore, when a load torque is increased to a value above the motor torque, the rotor of the motor is locked. A large current induced at the motor starting consequently continues to flow longer than a predetermined period necessary for the motor starting, for example, for 2 to 3 seconds. The switch housing interior temperature is increased owing to heat generated by resistive heating element 8 rather than the ambient temperature. When the calorific value of the heat generated by resistive heating element 8 is abnormally increased and the temperature of thermally responsive element 2 reaches the predetermined operative temperature or 150° C., thermally responsive element 2 changes its curvature by snap action as shown by dotted line in FIG. 1, thereby disengaging movable contact 2A from fixed contact 7 to interrupt energization to the motor. Subsequently, when thermally responsive element 2 is cooled such that the temperature thereof is decreased to, for example, 90° C., thermally responsive element 2 reverses its curvature again as shown by solid line in FIG. 1.

Figure 4:
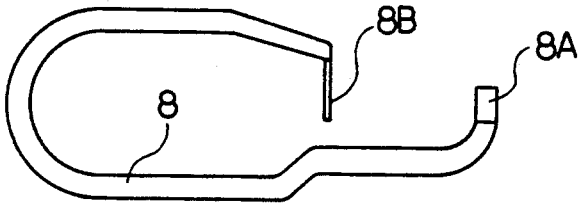
FIGS. 4 to 6 are plan, front and side views of a resistive heating element employed in the switch in FIG. 1, respectively.
Figure 5:
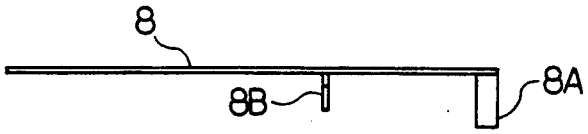
Figure 6:
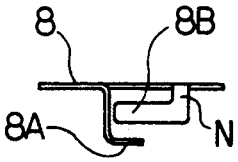

When applied to the thermally responsive switch shown in FIGS. 4 to 6, resistive heating element 8 shown in FIG. 2 is classified as a long resistive heating element. Therefore, resistive heating element 8 in FIG. 2 is suitable for the motors each having a small rated current. However, the motor protecting characteristics of the thermally responsive switch may be changed by selecting the conductive material composing resistive heating element 8 and having different specific resistances so that the specific resistance of the conductive material is matched with the motor rated current, as will be described later. Other than the configuration of the thermally responsive element shown in FIGS. 4 to 6, FIGS. 7 to 9 illustrate another resistive heating element 18 having a total length nearly half of that shown in FIGS. 4 to 6. Resistive heating element 18 may be employed in the thermally responsive switch in FIG. 2. More specifically, one end 18A of resistive heating element 18 is welded to projection 4C of lid member 4 and the other end 18B thereof is welded to terminal pin 6B. Further, the resistive heating element may be designed by selecting the length, cross sectional area and specific resistance thereof. In this case, one end of resistive heating element 18 is welded to terminal pin 6B and the other end is welded to any suitable portion of lid member 4. Thus, the position of stepped portion 4C is not limited to that shown in FIG. 1. For example, it is obvious that stepped portion 4C may be formed in the upper portion of lid member 4, as viewed in FIG. 1.

Figure 7:
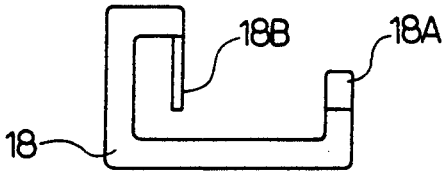
FIGS. 7 to 9 are plan, front and side views of a resistive heating element employed in the switch of another embodiment, respectively.
Figure 8:
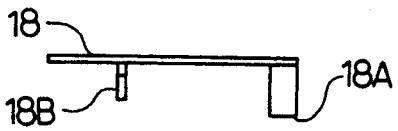

Molybdenum, iron, nichrome steel, iron-nichrome steel and the like are suitable for a material of the resistive heating element when the welding thereof, the welding facility, heat-proof characteristic thereof and the like are taken into account. Since these materials cover a wide range of the specific resistance, the resistive heating elements formed from these materials may suitably match various motors having various motor ratings by the combinations of the specific resistance values with the total length and cross sectional area thereof. Moreover, the on-off duty ratio of the thermally responsive switch may be changed by changing not only the resistance value of the resistive heating element but also a heat capacity thereof or the total cubic volume of the resistive heating element, thereby providing a desirable motor protecting characteristic. For example, the specific resistance of a resistive heating element shown in FIG. 4 is determined such that the total length and cross sectional area thereof is increased as much as possible. On the other hand, the specific resistance of a resistive heating element in FIG. 7 is determined so as to have the length and cross sectional area smaller than those of the element in FIG. 4. When the resistance of the electric path between terminal pins 6A and 6B in both resistive heating elements in FIGS. 4 and 7, the switch off period relative to the switch on period may be lengthened in the switch employing the resistive heating element in FIG. 4 than in the switch employing the element shown in FIG. 7 and consequently, the cycle number of on-off operations for a unit period may be reduced. Thus, since the on-off duty ratio may be desirably set, the operating life of the thermally responsive switch may be improved and the motor protecting characteristic thereof may be improved when the thermally responsive switch is applied to a motor having a high winding temperature rise rate in the case of the locked-rotor condition.

Figure 9:
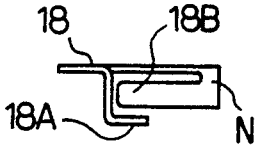

A portion of the resistive heating element designated N in each of FIGS. 6 and 9 has a cross sectional area smaller than the other portions of the resistive heating element. Each portion N serves as a fuse in order that the switch and motor are prevented from being subjected to an excessive heat while the contacts of the thermally responsive switch remain closed after expiration of the operating life of the switch.

When the above-described thermally responsive switch is employed for protecting a single-phase induction motor, the thermally responsive switch is sometimes required of different operative conditions to protect respective main and auxiliary windings. For example, when a starting relay is connected to an auxiliary winding and the capacitance of a capacitor is altered between the value during the motor starting and that during the normal run of the motor, contacts of the starting relay are sometimes fused to be united to each other. In such a case, the thermally responsive switch is employed to prevent the auxiliary winding side of the motor from being overheated. When a single thermally responsive switch is operated to protect the main and auxiliary windings individually, one terminal of the power supply is connected to terminal pin 6A of the thermally responsive switch in FIG. 1 and lid member 4 is electrically connected to one end of the motor main winding. Terminal pin 6B is connected to one end of the motor auxiliary winding. The other ends of both main and auxiliary windings are connected in common to the other terminal of the power supply. In this case, a main winding current flows through a circuit of terminal pin 6A, fixed contact 7, movable contact 2A, thermally responsive element 2, support 3, receptacle 1 and lid member 4 in sequence while an auxiliary winding current flows through a circuit of terminal pin 6A, fixed contact 7, movable contact 2A, thermally responsive element 2, support 3, lid member 4, resistive heating element 8 and terminal pin 6B in sequence. Resistances of both circuits are so determined that the temperature of thermally responsive element 2 exceeds a predetermined operating value in both of the occurrences of abnormal main and auxiliary winding currents. In determining the resistance of the circuit between terminal pin 6A and lid member 4, the resultant vector current of the main winding and auxiliary or phase winding currents needs to be taken into account.

Lid member 4 of the thermally responsive switch in FIG. 1 is provided with two through-holes 4A and 4B through which terminal pins 6A and 6B are disposed and secured in position with sealing materials 5A and 5B respectively in accordance with a so-called compression hermetic sealing. The terminal pins may be provided in accordance with a thermal expansion coefficient matching hermetic sealing in which the thermal expansion coefficients of parts are matched with one another. In this method, a single elliptic through-hole elongated in the direction of the length of lid member 4 is formed in lid member 4. Two terminal pins are disposed through the elliptic hole and hermetically secured by a sealing material in isolated and insulated relations to each other.

When support 3 of the switch in FIG. 1 is allowed to be formed of a conductive material having a high specific resistance, through-hole 4B, sealing material 5B and terminal pin 6B may be eliminated. The motor current is caused to flow through a circuit of terminal pin 6A, fixed contact 7, movable contact 2A, thermally responsive element 2, support 3, receptacle 1 and lid member 4.

In accordance with the thermally responsive switch of the present invention, as described above, the thermally responsive element carrying the movable contact is conductively secured to the support provided in the elliptic dome-shaped receptacle. Two terminal pins are disposed through the lid member having a relatively large thickness and hermetically and insulatively secured in position. The fixed contact is rigidly secured to one of the terminal pins conductively. Alternatively, a single terminal pin may be disposed through a through-hole formed in lid member. As the result of the above-described construction, the following advantages are obtained. The positional relationship between the fixed and movable contacts may be checked with ease. Furthermore, since the movement of the movable contact with snap action of the thermally responsive element is restricted to a space defined by the receptacle inner wall and the fixed contact, the snap-action changing and reversing temperatures of the thermally responsive element may be prevented from being deviated owing to shock forces and the productivity of the switch may be improved. Although the thermally responsive switch of the invention is compact in size, a plurality of terminal pins may be provided with ease, if necessary. Furthermore, the thermally responsive switch of the invention, which is durable and low in the production cost, may cover a wide range of applicable electric current value.

The foregoing disclosure and drawings are merely illustrative of the principles of the present invention and are not to be interpreted in a limiting sense. The only limitation is to be determined from the scope of the appended claims.

What we claim is:

1. A thermally responsive switch comprising:

(a) an elliptic dome-shaped receptacle formed of a metallic material and having an opening at one side thereof along its longitudinal direction, the receptacle having a peripheral wall including both ends in the longitudinal direction, each end having a spherical surface, and a section between the ends, the section having an arcuate transverse section;

(b) a support formed of an electrically conductive material and having two ends, said support being conductively secured at one end to an inner surface of one of the two spherical ends of said receptacle;

(c) a thermally responsive element disposed in said receptacle and having two ends, said thermally responsive element being secured at one end to the other end of said support, the other end of said thermally responsive element being positioned opposite an inner surface of the other spherical end of said receptacle with a predetermined space interposed therebetween, said thermally responsive element having a shallow dish-shaped portion for effecting a snap action and a movable contact carried on said other end thereof;

(d) a metallic lid member secured to said receptacle so as to hermetically close the opening of said receptacle, said lid member having a wall thickness greater than that of said receptacle, and also having a through-hole;

(e) a terminal pin formed of an electrically conductive material and inserted through the through-hole of said lid member to thereby be hermetically held in position with an electrically insulative material in the through-hole, said terminal pin having a fixed contact secured to a portion thereof positioned in said receptacle so that the movable contact is engaged with and disengaged from the fixed contact;

(f) an inwardly deformed portion provided so as to correspond to the spherical end portion of said receptacle to the inner wall of which said support is secured or the vicinity thereof, said inwardly deformed portion being inwardly deformed when subjected to an external force so that the contact pressure between the movable and fixed contacts is adjusted; and (g) a projection inwardly projected at the other spherical end of the receptacle so as to adjust the predetermined space between said other end of said thermally responsive element and the inner surface of said other spherical end of the receptacle, thereby limiting a moving range of said other end of said thermally responsive element.

2. A thermally responsive switch comprising:

(a) an elliptic dome-shaped receptacle formed of a metallic material and having an opening at one side thereof along its longitudinal direction, the receptacle having a peripheral wall including both ends in the longitudinal direction, each end having a spherical surface, and a section between the ends, the section having an arcuate transverse section;

(b) a support formed of an electrically conductive material and having two ends, said support being electrically conductively secured at one end to an inner surface of one of the two spherical ends of said receptacle;

(c) a thermally responsive element disposed in said receptacle and having two ends, said thermally responsive element being secured at one end to the other end of said support, the other end of said thermally responsive element being positioned opposite to an inner surface of the other spherical end of said receptacle with a predetermined space interposed therebetween, said thermally responsive element having a shallow dish-shaped portion for a snap action and a movable contact carried on said other end thereof;

(d) a metallic lid member secured to said receptacle so as to hermetically close the opening of said receptacle, said lid member having a wall thickness larger than said receptacle, and also having first and second through-holes;

(e) first and second terminal pins each formed of an electrically conductive material and inserted through the through-holes of said lid member, respectively, to thereby be hermetically held in position with an electrically insulative material charged in the through-holes;

(f) a fixed contact secured to a portion of said first terminal pin positioned in said receptacle so that the movable contact is engaged with and disengaged from the fixed contact;

(g) a resistive heating element disposed in said receptacle, said resistive heating element being connected at one of two ends thereof to said second terminal pin and at the other end to said lid member;

(h) an inwardly deformed portion provided so as to correspond to the spherical end portion of said receptacle to the inner wall of which said support is secured or the vicinity thereof, said inwardly deformed portion being inwardly deformed when subjected to an external force so that the contact pressure between the movable and fixed contacts is adjusted; and (i) a projection inwardly projected at the other spherical end of the receptacle so as to adjust the predetermined space between said other end of said thermally responsive element and the inner surface of said other spherical end of the receptacle, thereby limiting a moving range of said other end of said thermally responsive element.

* * * * *